US008931871B2

(12) United States Patent
Iwama

(10) Patent No.: US 8,931,871 B2
(45) Date of Patent: Jan. 13, 2015

(54) DRIVING DEVICE OF LIQUID-JET HEAD, LIQUID-JET DEVICE AND METHOD FOR DRIVING LIQUID-JET HEAD

(75) Inventor: Masami Iwama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 228 days.

(21) Appl. No.: 13/620,757

(22) Filed: Sep. 15, 2012

(65) Prior Publication Data

US 2013/0068850 A1 Mar. 21, 2013

(30) Foreign Application Priority Data

Sep. 20, 2011 (JP) ..... 2011-204824

(51) Int. Cl.
*B41J 29/38* (2006.01)
*B41J 2/045* (2006.01)

(52) U.S. Cl.
CPC ..... *B41J 2/04541* (2013.01); *B41J 2/0458* (2013.01); *B41J 2/04568* (2013.01); *B41J 2/04581* (2013.01)
USPC ..... 347/9; 347/10; 347/11; 347/5

(58) Field of Classification Search
CPC ..... B41J 2/04541; B41J 2/04568; B41J 2/04581; B41J 2/0458
USPC ..... 347/10, 11, 9, 5, 14, 19
See application file for complete search history.

(56) References Cited

U.S. PATENT DOCUMENTS

| | | | | |
|---|---|---|---|---|
| 6,109,802 | A | 8/2000 | Iwama et al. | |
| 2009/0231373 | A1 * | 9/2009 | Gardner | 347/11 |
| 2010/0220133 | A1 * | 9/2010 | Oshima et al. | 347/10 |

FOREIGN PATENT DOCUMENTS

| | | | | |
|---|---|---|---|---|
| JP | 2000-238262 | | 9/2000 | |
| JP | 2003-094638 | * | 4/2003 | B41J 2/045 |
| JP | 2003-94638 | | 4/2003 | |
| JP | 2003-170588 | * | 6/2003 | B41J 2/045 |
| JP | 2007-203493 | | 8/2007 | |

* cited by examiner

*Primary Examiner* — Henok Legesse
(74) *Attorney, Agent, or Firm* — Cooper & Dunham LLP

(57) ABSTRACT

Disclosed is a driving device of a liquid-jet head having a piezoelectric device arranged for each of nozzles and having mutually facing electrodes. The driving device includes switching devices connected in parallel to each other, one of the electrodes being connected to first ends of the switching devices for selectively ON/OFF controlling the switching devices while the other electrode is connected to a reference potential, a driving signal source to generate a driving signal connected to second ends of the switching devices, and a control unit to switch the driving signal to ON or OFF control the switching devices. At least one of the switching devices has electrically conducting properties for not ejecting a liquid drop from the nozzle with a driving signal being applied to the switching device in an ON-controlled status, and the switching devices are all ON-controlled for causing the nozzles to eject liquid drops.

5 Claims, 7 Drawing Sheets

DRIVING DEVICE OF LIQUID-JET HEAD, LIQUID-JET DEVICE AND METHOD FOR DRIVING LIQUID-JET HEAD

BACKGROUND OF THE INVENTION

1. Field of the Invention

The disclosures discussed herein relate to a driving device of a liquid-jet head to eject liquid drops from nozzles of the liquid-jet head, a liquid-jet device having such a driving device and a method for driving a liquid-jet head.

2. Description of the Related Art

There are various types of technologies for causing nozzles provided in a liquid-jet head to eject liquid drops.

For example, a piezo-type liquid-jet head is configured to eject liquid drops by utilizing a piezoelectric device to deform a vibrating plate constituting a wall surface of a liquid channel to change the volume of the liquid channel. Further, a thermal-type liquid-jet head is configured to eject liquid drops by utilizing a heat element to heat liquid inside a liquid channel to generate air bubbles such that the liquid drops are ejected by the pressure generated by the air bubbles. In addition, a electrostatic-type liquid-jet head is configured to eject liquid drops by utilizing electrostatic force generated between a vibrating plate and an electrode to deform the vibrating plate constituting a wall surface of a liquid channel to change the volume of the liquid channel.

Mechanical structures of the liquid-jet heads of these types may be easily simplified and downsized. Accordingly, the liquid-jet heads may be fabricated by utilizing an integrated circuit (IC) technology or a microprocessing technology markedly advanced in the recent semiconductor field, which may provide advantages for implementing high-density packaging while reducing the fabrication cost.

Further, since the liquid-jet heads of the above types electrically control ejection of liquid drops, various sizes of the liquid drops may be precisely controlled. Accordingly, it is advantageous for the liquid-jet heads of the aforementioned types to be incorporated into recording devices configured to eject microscopic liquid drops to form high definition images.

The liquid-jet device generally includes a liquid-jet head having a series of liquid drop channels including a pressure chamber containing liquid, plural nozzle arrays communicating with the pressure chamber and piezoelectric devices corresponding to the nozzles, and a driving signal generator circuit configured to generate driving signals to be applied to the piezoelectric devices. In the aforementioned configuration, the liquid-jet device is capable of ejecting liquid drops from the nozzles by applying driving signals generated from the driving signal generator circuit to the piezoelectric devices so as to change the pressure inside the pressure chamber.

Examples of wiring member to transmit the driving signals generated from the driving signal generator circuit include a flexible flat cable (hereinafter simply called "FFC") or a flexible printed circuit board (hereinafter simply called "FPC").

The wiring member generally includes an inductance component L, other than a resistance component R, that with a change in the current produced on induced electromotive force. The inductance component L has a property of changing the magnitude of the inductance component L based on the length of wire.

The resistance component R of the wiring member is extremely small. Hence, even if the length of wire is increased, the transmission of the driving signals will not be interfered with. However, the inductance component L changes with the length of wire or the diameter of a path, which generates the counter electromotive force $\Delta E$ ($=L\times(di/dt)$) that represents a product of the inductance component L and the current change rate per unit time (di/dt).

When the inductance component L becomes large due to an increase in the length of the wiring member, the counter electromotive force $\Delta E$ may become too large to be ignored as noise, which may become a cause of driving waveform distortion. The noise caused by the inductance component L may appear as overshoot or undershoot in the driving waveform.

If the amount of the overshoot or undershoot occurring in the driving waveform is constant, the driving waveform and the driving signal generator circuit may be prepared based on anticipation that such driving waveform distortion will occur.

However, the magnitude of overshoot or undershoot changes with the amount of current passing through the wiring member, which indicates that the magnitude of overshoot or undershoot changes with the number of nozzles that are driven in the liquid-jet head.

That is, if the number of nozzles is small, the driving waveform distortion may be small, and if the number of nozzles is large, the driving waveform distortion may be large. Hence, the driving waveform changes with the number of driven nozzles, which may cause a change in liquid-jet properties.

Japanese Laid-open Patent Publication No. 2007-203493 (hereinafter referred to as "Patent Document 1") discloses a technology for stabilizing ink drop ejection properties. In this technology, the inkjet printer includes plural capacitive loads to be connected to/disconnected from a supply wire of a drive pulse in parallel. The connection/disconnection conditions of the capacitive loads to the supply wire of the drive pulse are set based on either the number of nozzles driven for ejecting ink droplets or piezoelectric actuators for driving the nozzles. This makes total electrostatic capacitance of the capacitive loads to be connected to the supply wire of the drive pulse to be a constant value. As a result, the ink drop ejection properties may be stabilized.

RELATED ART DOCUMENT

Patent Document

Patent Document 1: Japanese Laid-open Patent Publication No. 2007-203493

However, the inkjet printer disclosed in Patent Document 1 may require the capacitive loads to be connected to a head end of the wiring member for transmitting the driving signals and a switching device. In addition, since the capacitive loads are difficult to be integrated in the IC or the like, the inkjet printer further requires additional components such as a capacitor. This may result in increasing the sizes of the components and cost.

SUMMARY OF THE INVENTION

Accordingly, it is a general object of at least one embodiment of the present invention to provide a driving device of a liquid-jet head, a liquid-jet device and a method for driving the liquid-jet head capable of stabilizing liquid-jet properties of the liquid-jet head without increasing sizes of its components and fabrication cost while reducing a change in driving signals applied to the liquid-jet head, which substantially eliminate one or more problems caused by the limitations and disadvantages of the related art.

In one embodiment, there is provided a driving device of a liquid-jet head, the liquid-jet head having a piezoelectric device arranged corresponding to each of nozzles, the piezoelectric device having mutually facing electrodes, and a driving signal being applied to the piezoelectric device for causing a corresponding one of the nozzles to eject a liquid drop. The driving device includes a plurality of switching devices connected in parallel to each other, one of the electrodes being connected to first ends of the switching devices for selectively ON or OFF controlling the switching devices while the other electrode is connected to a reference potential part having a reference potential; a driving signal source configured to generate a driving signal, the driving signal source being connected to second ends of the switching devices; and a control unit configured to switch the driving signal generated from the driving signal source to ON or OFF control the switching devices. In the driving device, at least one of the switching devices has electrically conducting properties for not ejecting a liquid drop from a corresponding one of the nozzles with a driving signal being applied to the switching device in an ON-controlled status, and the switching devices having the electrically conducting properties for not ejecting liquid drops from the corresponding nozzles are all ON-controlled for causing one or more of the nozzles to eject liquid drops.

In another embodiment, there is provided a method for driving a liquid-jet head, the liquid-jet head having a piezoelectric device arranged corresponding to each of nozzles, the piezoelectric device having mutually facing electrodes, and a driving signal being applied to the piezoelectric device for causing a corresponding one of the nozzles to eject a liquid drop. The driving device includes connecting one of the electrodes to a reference potential part having a reference potential; connecting the other electrode to first ends of a plurality of switching devices connected in parallel to each other for selectively ON or OFF controlling the switching devices; connecting a driving signal source configured to generate a driving signal to second ends of the switching devices, at least one of the switching devices having electrically conducting properties for not ejecting a liquid drop from a corresponding one of the nozzles with a driving signal being applied to the switching device in an ON-controlled status; and ON-controlling the switching devices having the electrically conducting properties for not ejecting liquid drops from the corresponding nozzles for causing one or more of the nozzles to eject liquid drops.

Additional objects and advantages of the embodiments will be set forth in part in the description which follows, and in part will be obvious from the description, or may be learned by practice of the invention.

It is to be understood that both the foregoing general description and the following detailed description are exemplary and explanatory only and are not restrictive of the invention as claimed.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Preferred embodiments are described below, with reference to accompanying drawings.

Configuration of Liquid-Jet Device

Figure 1:
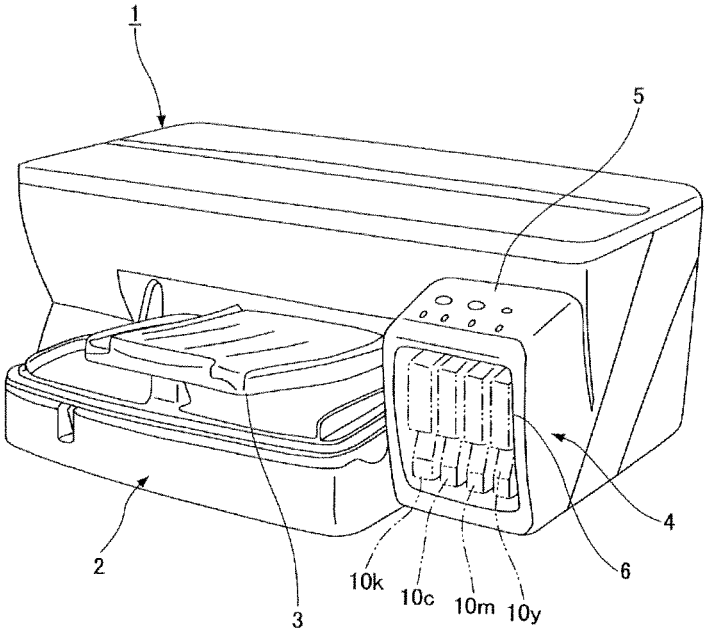
FIG. 1 is an appearance perspective diagram illustrating an inkjet recording device according to an embodiment.

FIG. 1 is an appearance perspective diagram illustrating an inkjet recording device serving as a liquid-jet device according to an embodiment viewed from a front side.

The inkjet recording device includes a device main body 1, a sheet-feeding tray 2 attached to the device main body 1, and a catch tray 3 removably attached to the device main body 1. The sheet-feeding tray 2 is utilized for supplying a sheet of paper (hereinafter simply called a "sheet") and the catch tray 103 is utilized for receiving the sheet after having formed (recorded) an image on the sheet.

The inkjet recording device according to the embodiment further includes a cartridge attachment part 4 on one end part of the front surface of the device main body 1 (i.e., the sheet-feeding tray 2 and catch tray 3 side), such that ink cartridges are attached to the device main body 1 via the cartridge attachment part 4. The cartridge attachment part 4 includes an operation/display part 5 such as operations buttons and a display on its surface.

The cartridge attachment part 4 includes ink cartridges of different colors. The ink cartridges (main tanks) 10*k*, 10*c*, 10*m* and 10*y* (also simply referred to as an "ink cartridge 10" as a generic name when different colors are not considered) contain ink of different color materials such as black (K) ink, cyan (C) ink, magenta (M) ink and yellow (Y) ink. The ink cartridge 10 is attached to the cartridge attachment part 4 such that the ink cartridge 10 is inserted into the cartridge attachment part 4 from a front side to a rear side of the main body 1.

The cartridge attachment part 4 further includes a front cover (cartridge cover) 6 on its front side. The front cover 6 is configured to open when the ink cartridge 10 is inserted into the cartridge attachment part 4 and close after the ink cartridge 10 has been inserted. Further, the ink cartridges 10*k*, 10*c*, 10*m* and 10*y* are in a portrait orientation and aligned parallel to one another in a horizontal direction.

The operation/display part 5 includes remaining ink display parts 111*k*, 111*c*, 111*m* and 111*y* configured to display respective remaining amounts of ink in the cartridges 110*k*, 110*c*, 110*m* and 110*y* at respective attachment positions (respective disposed positions) of the ink cartridges 110*k*, 110*c*, 110*m* and 110*y* when ink in the cartridges 110*k*, 110*c*, 110*m* and 110*y* are in a near end status or in an end status. The operation/display part 5 further includes a power button, a sheet feeding/printing restart button and a cancelling button.

Figure 2:
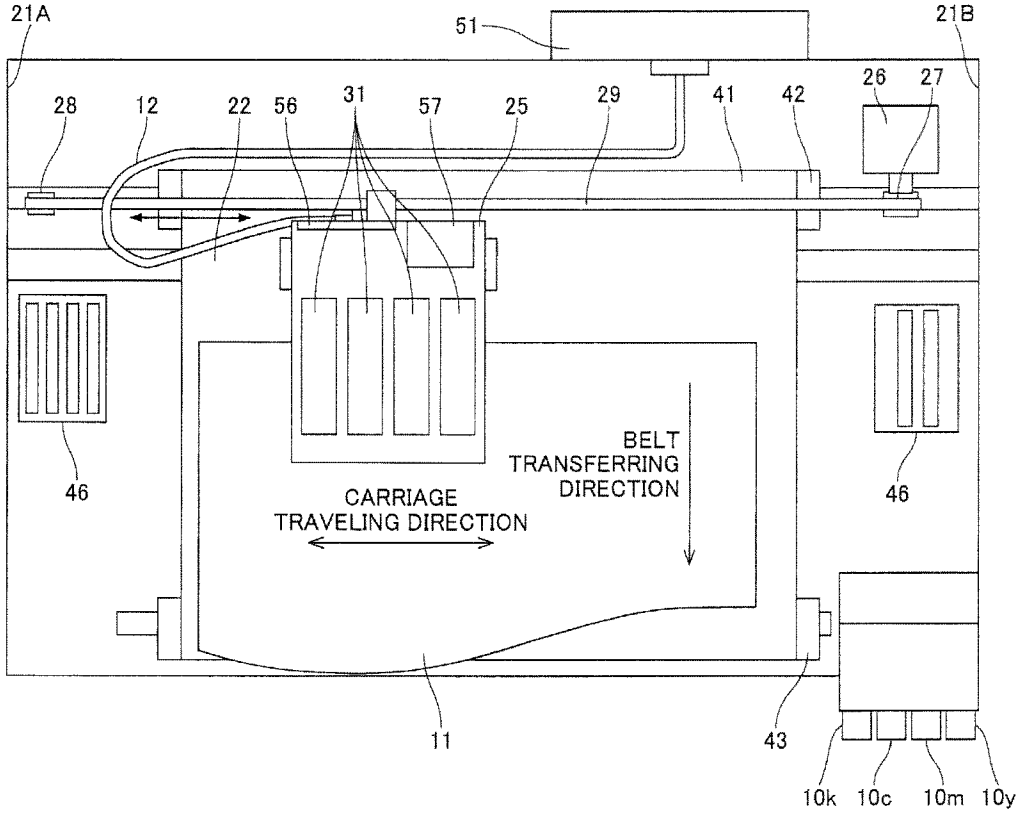
FIG. 2 is a schematic diagram illustrating a mechanical part of the inkjet recording device according to the embodiment.

Next, a mechanical part of the inkjet recording device is described with reference to FIG. 2. FIG. 2 is a schematic plan diagram illustrating the mechanical part of the inkjet recording device 1 according to the embodiment.

In the mechanical part of the inkjet recording device 1, a carriage 25 is slidably supported by a guide rod 22 and a not-illustrated sub-guide member (a guide rod, guide stay or the like) in a main-scanning direction (a longitudinal direction of a guide rod). The guide rod 22 serves as a main guide member laterally bridging between main side plates 21A and 21B, which constitute frame members of the device main body 1.

The carriage 25 is moved by a main scanning mechanism composed of a main-scanning motor 26, a driving pulley 27, a driven pulley 28 and a timing belt 29 while scanning in the main-scanning direction.

The carriage 25 includes four liquid-jet heads 31 incorporating respective sub-tanks and respectively ejecting black (K) ink, cyan (C) ink, magenta (M) ink and yellow (Y) ink.

Each of the four liquid-jet heads 31 includes a nozzle array composed of plural nozzles in the sub-scanning direction orthogonal to the main-scanning direction. The four liquid-jet heads 31 are attached to the carriage 25 with liquid-jet directions of the liquid-jet heads 31 being downwardly directed.

In the carriage 25, driving signals from a driving signal substrate 51 are supplied to the liquid-jet heads 31 via a flexible flat cable (FCC) 12 attached to a rear surface of the carriage 25 and an intermediate substrate 56 attached to the carriage 25.

Meanwhile, in the mechanical part of the inkjet recording device 1, a transfer belt 41 is arranged at a position below the carriage 25. The transfer belt 41 serves as a transferring unit configured to transfer a sheet 11 supplied from a not-illustrated sheet-feeding cassette in the sub-scanning direction. The transfer belt 41 is an endless belt that is looped over a transfer roller 42 and a tension roller 43 that are rotationally supported between not-illustrated sub-side plates. Hence, the transfer belt 41 rotationally travels in a belt transferring direction (i.e., the sub-scanning direction in FIG. 2) according to the rotation of the transfer roller 42 that is rotationally driven by a not-illustrated sub-scanning motor.

Structure of Liquid-Jet Head

Next, a structure of the liquid-jet head 31 is described with reference to a cross-sectional diagram of the liquid-jet head 31 illustrated in FIG. 3.

The liquid-jet head 31 includes a drive unit 102 and a liquid chamber unit 104.

The drive unit 102 includes a frame member 80 formed of thermoplastic resin and having a hollow part 80*a* serving as a pressure generator device accommodating space at its central part, and a pressure generator device 82 arranged inside the hollow part 80*a*.

Further, common liquid chambers 80*b* and 80*c* are respectively arranged at two opposite sides of the hollow part 80*a* in a direction orthogonal to a longitudinal direction (hereinafter also called a "short direction") of the frame member 80.

The pressure generator device 82 includes a rectangular base member 84 formed of a rigid material such as ceramics, metal, or stainless-steel, and plural piezoelectric devices 86 arranged in a matrix with 2 rows and n columns on a base member 84.

Figure 3:
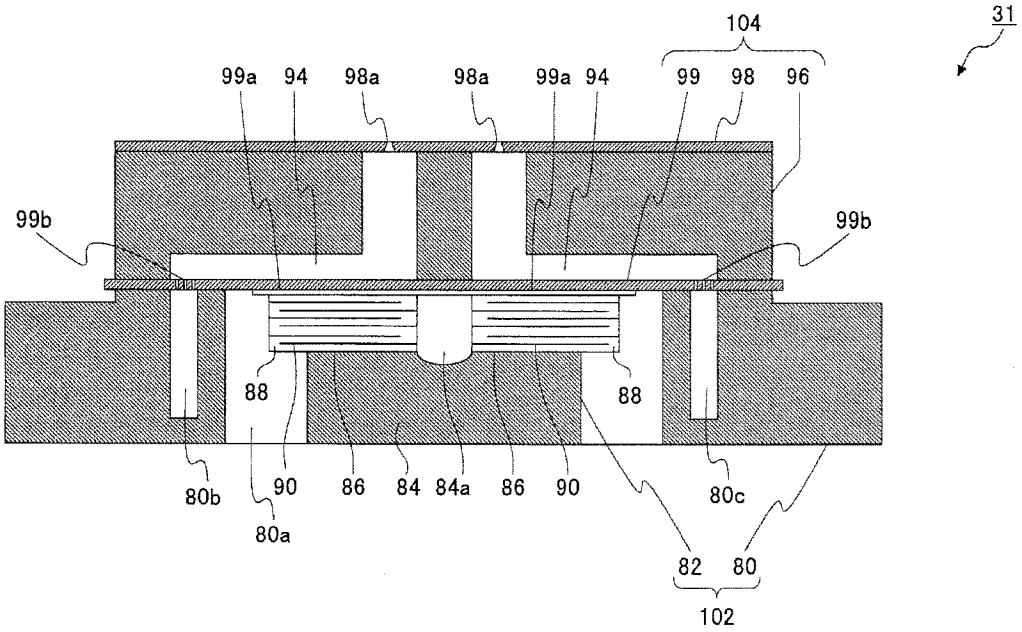
FIG. 3 is a cross-sectional diagram illustrating a liquid-jet head of the inkjet recording device according to the embodiment.

Each of the piezoelectric devices 86 is formed of a stacked piezoelectric device illustrated in FIG. 3. Numerous internal electrodes 90 of the piezoelectric device 86 are alternately extended to opposite end faces, and each of the extended internal electrodes 90 is connected to a corresponding one of not-illustrated individual end face electrodes made of AgPd alloy. Further, individual end face electrodes facing other piezoelectric devices corresponding to the piezoelectric devices 66 of the same rows are connected to a not-illustrated common electrode on the base member 84.

Although not illustrated in FIG. 3, the individual end face electrodes and the common electrode not facing the other piezoelectric devices corresponding to the piezoelectric devices 86 of the same rows are connected to a flexible printed circuit board (FPC) by soldering, and the common electrode is connected to a reference potential.

An electric field is generated in a stacked direction of each of the piezoelectric devices by the application of the driving signals generated from the driving signal generator circuit via switching devices, the driving signal generator circuit serving as a driving signal source. Stretching displacement occurs in each of the piezoelectric devices in the stacked direction (displacement in a d33 direction same as the electric field), and liquid drops are thus ejected from nozzles 98*a*.

Driving Device of Liquid-Jet Head

The outline of a driving device of the liquid-jet head 31 according to the embodiment is described below.

Figure 4:
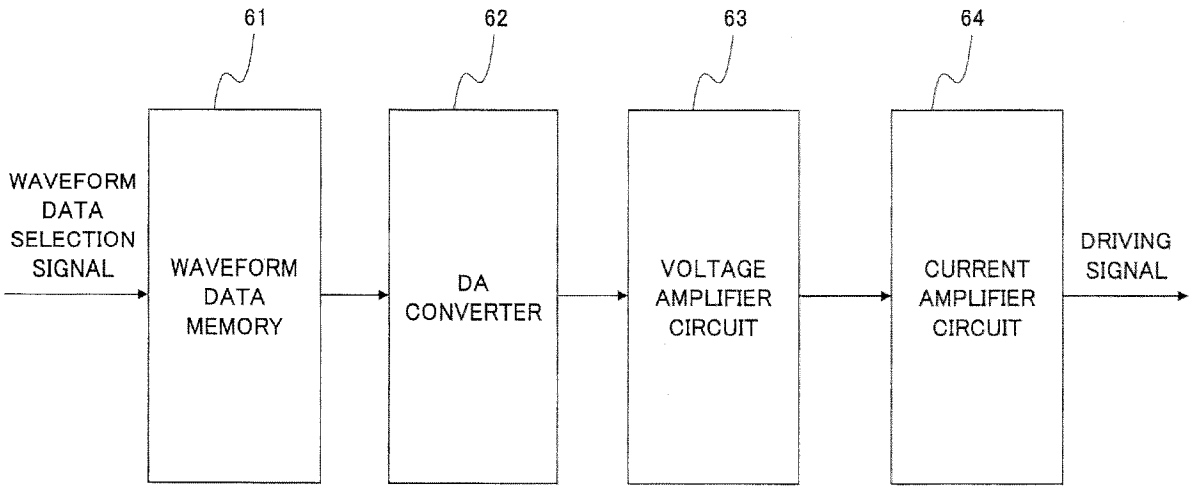
FIG. 4 is a block diagram of a driving signal generator circuit part of a driving signal circuit board in the inkjet recording device according to the embodiment.

FIG. 4 is a block diagram illustrates a driving signal generator circuit part of the driving signal substrate 51.

In the liquid-jet device 1 according to the embodiment, driving signals generated within the driving signal substrate 51 are supplied to the liquid-jet head 31, which changes an internal volume of the liquid chamber to eject liquid drops.

A waveform data memory 61 records waveform data corresponding to sizes of liquid drops and ink-specific temperatures. In the inkjet recording device 1, a control unit is configured to select waveform data, update waveform data per a predetermined time while generating the waveform data, and output digital driving waveform data.

The digital waveform data output from the waveform data memory 61 are converted into an analog signal by a DA converter 62. The voltage and current of the converted analog signal are then amplified by a voltage amplifier circuit 63 and a current amplifier circuit 64, respectively, and the amplified voltage and the current serve as a driving signal of the liquid-jet head 31.

Figure 5:
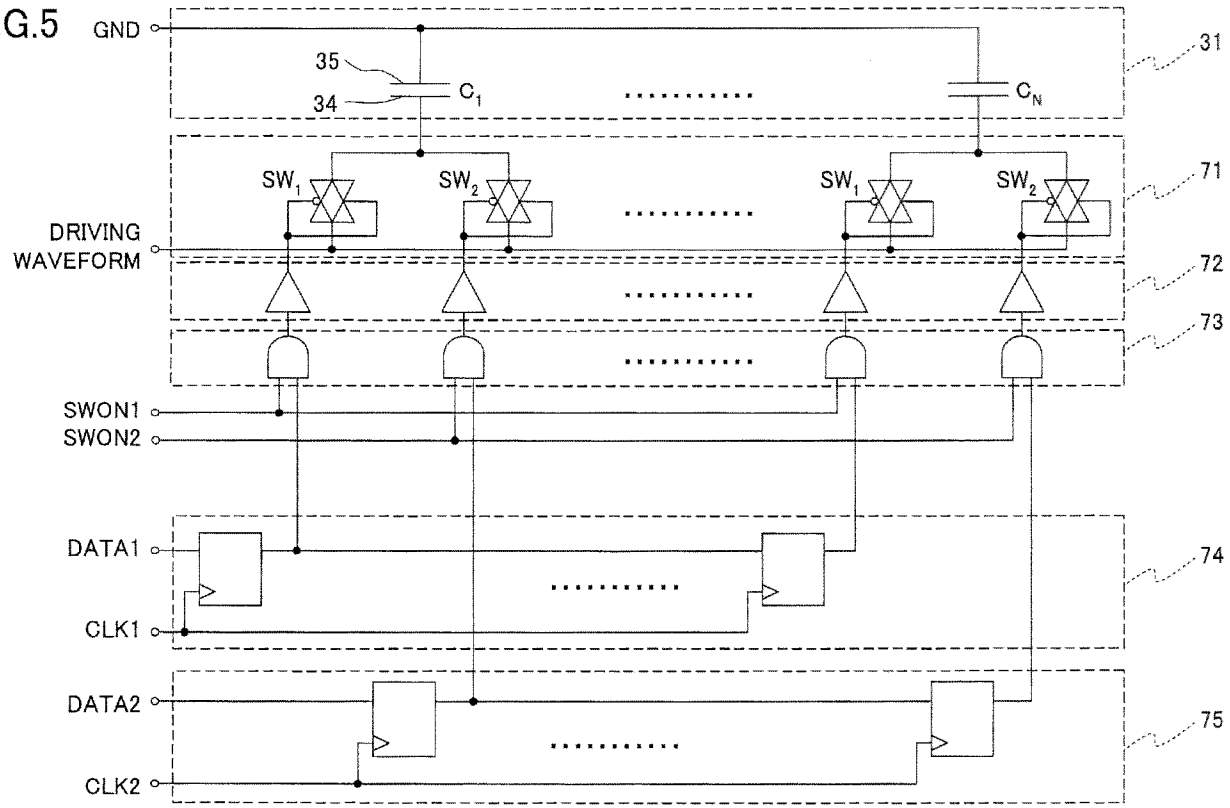
FIG. 5 is a circuit diagram illustrating a liquid-jet head and a driving device of a liquid-jet head in the inkjet recording device according to the embodiment.

FIG. 5 is a circuit diagram illustrating the liquid-jet head 31 and a driving device of the liquid-jet head 31 in the inkjet recording device according to the embodiment.

Since a capacitor C is formed of each of individual electrodes 34 facing a corresponding one of the nozzles, and a common electrode 35, the liquid-jet head 31 has a configuration to include an electrically capacitive actuator formed of the capacitor C and the piezoelectric device 86.

The common electrode 35 is connected to a ground GND serving as a reference potential part having a low impedance reference potential. Further, in an analog switching circuit 71, each of the individual electrodes 34 is connected to first ends of switching devices SW1 and SW2 that are connected in parallel to each other.

In this embodiment, a configuration example of two switching devices SW1 and SW2 that are connected in parallel to each other is described. However, the number of switching devices SW that are connected in parallel to the corresponding individual electrode is not limited to two. The number of switching devices SW that are connected in parallel to one another may be two or more.

Recording data are transmitted to the analog switching circuit 71 via a decoder 73 and a level shifter 72 from shift registers 74 and 75. The analog switching circuit 71 selects one of the piezoelectric devices 86 to be driven based on the recording data, and selectively ON or OFF controls the switching devices SW corresponding to the selected piezoelectric device to be driven. For example, when data "1" or data "2" are recorded as recording data into the corresponding shift register 74 or 75 to switch a signal SWON1 or SWON2 to a "high level", the signal SWON1 or SWON2 switched to the high level serves as the driving signal to ON-control a specific one of the switching devices SW, and consequently, the driving signal is applied to the piezoelectric device 86. Note that the shift registers 74 and 75 serve as a control unit of the driving device configured to switch the respective signals SWON1 and SWON2 to ON or OFF control the corresponding switching devices SW.

The switching device SW 1 includes a resistance value R1 for causing a nozzle to eject liquid drops when the switching device SW1 is ON-controlled (in an ON-controlled status) to apply a driving signal to the piezoelectric device 86, while the switching device SW2 connected in parallel to the switching device SW1 is in an OFF-controlled status. The switching device SW2 includes a resistance value R2 for not causing a nozzle to eject liquid drops when the switching device SW2 is ON-controlled (in an ON-controlled status) to apply a driving signal to the piezoelectric device 86, while the switching device SW1 connected in parallel to the switching device SW2 is OFF-controlled (in an OFF-controlled status).

Note that the resistance value R2 of the switching device SW2 set in this embodiment is 10 times the resistance R1 of the witching device SW1. However, the resistance values R1 and R2 are not limited to those values, and may be able to be set appropriately.

The driving signal of the liquid-jet head 31 is output the driving signal substrate 51, the output driving signal passes through the flexible flat cable (FFC) 12, and the driving signal having passed through the FFC 12 is supplied to the piezoelectric device 86 via the switching device SW.

Note that since the FFC 12 includes a resistance component R and an inductance component L, counter electromotive force that is a noise component may be generated in the FFC 12. This may induce undershoot or overshoot in the driving waveform.

Switching Device Control and Driving Waveform

FIGS. 6A to 6D are diagrams illustrating examples of driving waveforms applied to a piezoelectric device utilized in the inkjet recording device according to the embodiment.

Figure 6A:
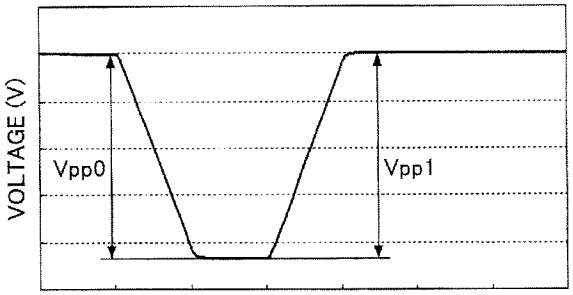
FIGS. 6A to 6D are diagrams illustrating examples of driving waveforms applied to a piezoelectric device utilized in the inkjet recording device according to the embodiment.

FIG. 6A is a diagram specifically illustrating a driving waveform when liquid drops are ejected from only one nozzle by ON-controlling one of the switching devices SW1 while OFF-controlling all the switching devices SW2.

Figure 6B:
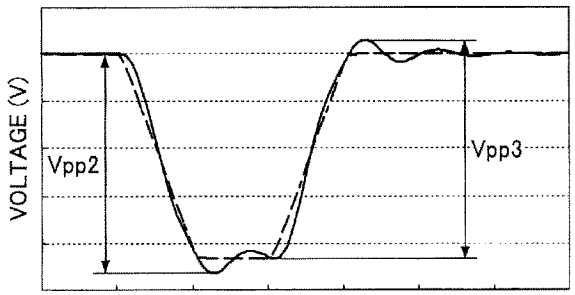

Further, FIG. 6B is a diagram specifically illustrating a driving waveform when liquid drops are ejected from all the nozzles by ON-controlling all the switching devices SW1 while OFF-controlling all the switching devices SW2. In FIG. 6B, a broken line illustrates the driving waveform when the liquid drops are ejected from only one nozzle illustrated in FIG. 6A.

When all the nozzles are driven as illustrated in FIG. 6B, overshoot and undershoot may be induced in the driving waveform due to the effect of the counter electromotive force generated in the FEC 12. Accordingly, a voltage Vpp of a falling part of the driving waveform is increased to a voltage Vpp2 while a voltage Vpp 1 of a rising part of the driving waveform is increased to a voltage Vpp3 as illustrated in FIG. 6B when comparing the case of driving the nozzles (i.e., FIG. 6B) with the case of driving of only one nozzle in FIG. 6A.

As illustrated in FIG. 6B, since overshoot and undershoot are generated in the driving waveform, a liquid-jet speed of the case of driving all of the nozzles is increased compared to a liquid-jet speed in the case of driving only one of the nozzles. Accordingly, image quality may deteriorate due to shifting of printing positions.

Figure 6C:
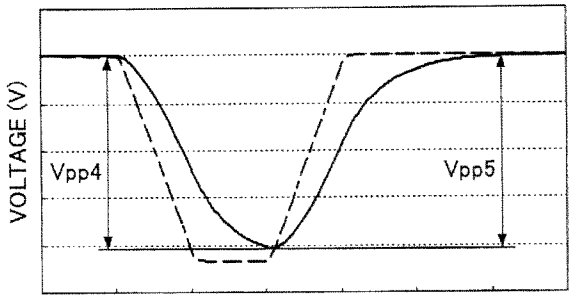

FIG. 6C is a diagram specifically illustrating a driving waveform when a driving signal is applied to only one nozzle by ON-controlling one of the switching devices SW2 while OFF-controlling all the switching devices SW1. In FIG. 6C, a broken line illustrates the driving waveform when the liquid drops are ejected from only one nozzle illustrated in FIG. 6A.

In this case, a voltage Vpp4 of the rising part of the driving waveform, and a voltage Vpp5 of the falling part of the driving waveform are smaller than the respective voltages Vpp0 and Vpp1 of the case illustrated in FIG. 6A, where only one nozzle is driven by the switching device SW1. Further, the rising part of the driving waveform and the falling part of the driving waveform in FIG. 6C exhibit gentler curves compared to those of the driving waveform in FIG. 6A. Accordingly, even if the driving signal is applied to the nozzle by ON-controlling the switching device SW2, the nozzle will not eject liquid drops.

Thus, the resistance value R2 is set in the switching device SW2 such that even if the identical driving signals are applied, the driving waveforms differ between the switching device SW1 and the switching device SW2. Further, even if the driving signal is applied by ON-controlling the switching device SW2, liquid drops will not be ejected from the corresponding nozzle.

Thus, when one or more nozzles of all of the nozzles in the liquid-jet head 31 are caused to eject liquid drops, the driving signals are applied to the nozzles by OFF-controlling the switching devices SW2 corresponding to the non-ejecting nozzles. Accordingly, it may be possible to reduce the difference in the amount of current flowing through the FFC 12 between the case of driving only one nozzle and the case of driving all of the nozzles while causing the necessary nozzles to eject liquid drops. This may control the amount of the counter electromotive force generated in the FFC 12 to reduce the difference between the driving waveforms due the number of driven nozzles. As a result, liquid-jet properties of the nozzles may be stabilized.

Figure 6D:
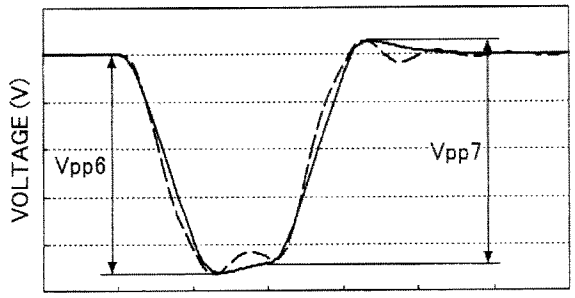

FIG. 6D is a diagram specifically illustrating a driving waveform when liquid drops are ejected from only one nozzle by ON-controlling one of the switching devices SW1 while ON-controlling all the switching devices SW2 not to eject liquid drops. In FIG. 6D, a broken line illustrates the driving waveform when the liquid drops are ejected from all of the nozzles by ON-controlling all the switching devices SW1 illustrated in FIG. 6B.

In this case, the amounts of undershoot and overshoot in the driving waveform are increased compared to the case of causing only one nozzle to eject liquid drops while OFF-controlling the switching devices SW2 illustrated in FIG. 6A. This is because a constant amount of current is caused to flow by ON-controlling the switching devices SW2 corresponding to the non-ejecting nozzles.

However, the difference between the voltages Vpp2 and Vpp6 in the falling time and the difference between the voltages Vpp3 and Vpp7 may be reduced in comparison with the case illustrated in FIG. 6B, where liquid drops are ejected from all of the nozzles by ON-controlling the switching devices SW1 corresponding to those nozzles.

Accordingly, the liquid drops may be ejected stably without any change in the liquid ejection properties due to the number of driven nozzles by reducing the difference to be subtle between the waveform obtained by driving one nozzle and the waveform obtained by driving all of the nozzles. Further, in the liquid-jet device 1 having the driving device of the liquid-jet head 31 according to the embodiment, ejection of the liquid drops is stabilized such that shifting of the printing positions will not occur. Accordingly, the liquid-jet device 1 may be able to output a high quality image.

As described above, the liquid-jet properties are stabilized by ON-controlling all the switching devices SW2 corresponding to the non-ejecting nozzles in this embodiment. However, the switching devices SW2 may alternatively be ON-controlled by detecting the number of ejecting nozzles ejecting the liquid drops, and ON-controlling the switching devices SW2 to the extend in which liquid-jet properties are not degraded corresponding to the number of driven nozzles.

Figure 7:
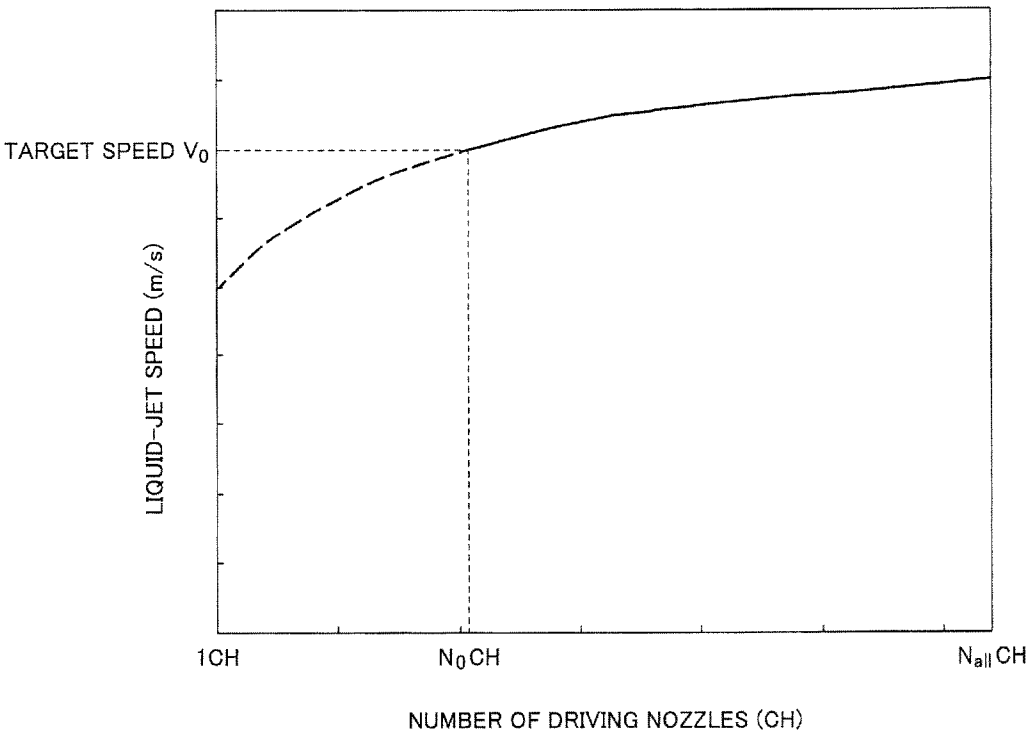
FIG. 7 is a diagram illustrating a relationship between the number of nozzles ejecting liquid drops and speeds of the liquid drops in the inkjet recording device according to the embodiment.

FIG. 7 is a graph illustrating a relationship between the number of nozzles ejecting liquid drops and speeds of the liquid drops.

The graph in FIG. 7 illustrates the relationship between the number of nozzles ejecting liquid drops and the speeds of the liquid drops when only the switching devices SW1 are ON and OFF controlled while all the switching devices SW2 are OFF-controlled.

The speeds of the liquid drops are changed due to overshoot and undershoot occurring in the driving waveform corresponding to the number of driven nozzles ejecting the liquid drops, and the speeds of the liquid drops are increased with an increase in the number of driven nozzles. In the inkjet recording device 1, a change in the speeds of the liquid drops causes the shifting of the printing positions, which degrades the image quality.

Hence, the switching devices SW2 may be ON-controlled by detecting the number of driven nozzles such that the speeds of the liquid drops reach a target speed $V_0$ under a condition in which the number of driven nozzles is $N_0$CH or less (see a graph in FIG. 7). This may stabilize the speeds of the liquid drops without degrading the image quality.

The number of nozzles ejecting the liquid drops may be detected based on the image data. Hence, the liquid-jet properties may be improved while reducing the electric power consumption by changing the number of nozzles. The number of nozzles is changed by ON-controlling the switching devices SW2 based on the detected number of nozzles compared to the case of ON-controlling all the switching devices SW2 corresponding to non-ejecting nozzles.

Further, when R1 represents the resistance value for ejecting the liquid drops from the nozzles and R2 represents the resistance value for not ejecting the liquid drops from the nozzles under a condition in which the driving signals are applied by ON-controlling the switching devices SW, a resistance value R1' of the switching devices SW1 is set as "R1'=(R1×R2/(R2−R1))", and a resistance value of the switching devices SW2 is set as R2.

With the above settings, a synthetic resistance of the switching devices SW1 and SW2 that are connected in parallel to each other corresponds to the resistance value R1 for ejecting the liquid drops. Accordingly, the nozzles may be caused to eject the liquid drops under a condition in which all the switching devices SW connected in parallel are ON-controlled.

Thus, the nozzles may be able to eject the liquid drops by selectively ON or OFF controlling the switching devices SW1 alone, while the switching devices SW2 corresponding to all of the nozzles are ON-controlled. Controlling the switching devices SW in the aforementioned manner may be capable of reducing a change in the amount of current flowing into the FFC 12 to reduce a change in the driving waveform, which may stabilize the liquid-jet properties.

Further, the synthetic resistance value of the switching devices SW1 and SW2 connected in parallel to each other is equivalent to a generally required resistance value for ejecting the liquid drops. In addition, there is virtually no increase in an IC chip area. Hence, it may be easy to integrate the switching devices SW into one IC.

Accordingly, it may be possible to stabilize the liquid-jet properties of the liquid-jet head without increasing the sizes of its components and cost while reducing a change in the driving waveforms applied to the liquid-jet head.

Overview

As described above, among the switching devices SW1 and the switching devices SW2 that are connected in parallel to one another, each of the switching devices SW2 includes the resistant value R2 for not causing a nozzle to eject the liquid drops when the switching devices SW2 are ON-controlled to apply the driving signals. The amount of current flowing into the FFC 12 may be capable of falling within a predetermined range and the change in the driving waveform corresponding to the number of driven nozzles may be lowered by ON-controlling the switching devices SW2 corresponding to the non-ejecting nozzles when the nozzles of the liquid-jet head 31 eject the liquid drops.

Thus, according to the embodiment, it may be possible to stabilize the liquid-jet properties of the liquid-jet head 31. Hence, the liquid-jet head 31 may be capable of constantly ejecting a predetermined amount of the liquid drops. Further, in the inkjet recording device 1 having the driving device of the liquid-jet head 31 according to the embodiment, the shifting of the printing positions will not occur. Accordingly, the inkjet recording device 1 may be able to stably form a high quality image.

According to the above embodiments, when the liquid-jet head is to eject liquid drops, the switching devices corresponding to the non-ejecting nozzles are ON-controlled. As a result, a constant amount of current may flow in the FFC even if the number of driven nozzles is small, the amount of change in the driving waveform due to the change in the number of driven nozzles may be reduced, and the liquid-jet properties may be stabilized.

Note that the arrangements and configurations described as the above embodiment have been described heretofore for the purpose of illustration; however, the present invention should not be limited to the foregoing description of the embodiment. The present invention may be taken into practice by adding various modifications to the foregoing embodiment without departing from the gist of the invention.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This patent application is based on Japanese Priority Patent Application No. 2011-204824 filed on Sep. 20, 2011, the entire contents of which are hereby incorporated herein by reference.

What is claimed is:

1. A driving device of a liquid-jet head, the liquid jet head having a piezoelectric device arranged corresponding to each of nozzles, the piezoelectric device having mutually facing electrodes, and a driving, signal being applied to the piezoelectric device for causing a corresponding one of the nozzles to eject a liquid drop, the driving device comprising:

a plurality of switching devices connected in parallel to each other, one of the electrodes being connected to first ends of the switching devices while the other electrode is connected to a reference potential having a reference potential;

a driving signal source configured to generate a driving signal for selectively ON or OFF controlling the switching devices, the driving signal source being connected to second ends of the switching devices; and a control unit configured to switch the driving signal generated from the driving signal source to ON or OFF control the switching devices, wherein at least one of the switching devices is connected in parallel to remaining ones of the switching devices that are OFF-controlled, and said at least one of the switching devices has electrically conducting properties configured to cause a liquid drop not to be ejected from a corresponding one of the nozzles when a driving signal is applied to said at least one of the switching device in an ON-controlled status, and all of said at least one of the switching devices having the electrically conducting properties configured to cause liquid drops not to be ejected from the corresponding nozzles are ON-controlled, while one or more of the remaining ones of the switching devices are ON-controlled for causing one or more of the nozzles to eject liquid drops.

2. The driving device as claimed in claim 1, wherein the switching devices connected in parallel to each other have electrically conducting properties for ejecting liquid drops from the corresponding nozzles with the switching devices being all in an ON-controlled status, and the switching devices having the electrically conducting properties for ejecting liquid drops from the corresponding nozzles are all ON-controlled for causing one or more of the nozzles to eject liquid drops.

3. The driving device as claimed in claim 1, wherein the switching devices are integrated into one semiconductor.

4. A liquid-jet device comprising:

the driving device of the liquid-jet head as claimed in claim 1.

5. A method for driving a liquid-jet head, the liquid-jet head having a piezoelectric device arranged corresponding to each of nozzles, the piezoelectric device having mutually facing electrodes, and a driving signal being applied to the piezoelectric device for causing a corresponding one of the nozzles to eject a liquid drop, the driving device comprising:

connecting one of the electrodes to a reference potential part having a reference potential;

connecting the other electrode to first ends of a plurality of switching devices connected in parallel to each other;

connecting a driving signal source configured to generate a driving signal, for selectively ON or OFF controlling the switching devices, to second ends of the switching devices, at least one of the switching devices being connected in parallel to remaining ones of the switching devices that are OFF-controlled, and said at least one of the switching devices having electrically conducting properties configured to cause a liquid drop not to be ejected from a corresponding one of the nozzles with a driving signal being applied to said at least one of the switching device in an ON-controlled status; and ON-controlling all of said at least one of the switching devices having the electrically conducting properties configured to cause liquid drops not to be ejected from the corresponding nozzles, while one or more of the remaining ones of the switching devices are ON-controlled for causing one or more of the nozzles to eject liquid drops.

* * * * *